US008511875B2

(12) United States Patent
Spork et al.

(10) Patent No.: US 8,511,875 B2
(45) Date of Patent: Aug. 20, 2013

(54) LIGHTING UNIT FOR VEHICLES AND MOUNTING METHOD

(75) Inventors: Heinz-Uwe Spork, Lippstadt (DE); Sonia Martinez, Lippstadt (DE); David Hanuschkiewitz, Werne (DE)

(73) Assignee: Hella KGaA Hueck & Co., Lippstadt (DE)

( * ) Notice: Subject to any disclaimer, the term of this patent is extended or adjusted under 35 U.S.C. 154(b) by 339 days.

(21) Appl. No.: 12/950,214

(22) Filed: Nov. 19, 2010

(65) Prior Publication Data

US 2011/0122643 A1 May 26, 2011

(30) Foreign Application Priority Data

Nov. 25, 2009 (EP) ..... 09177001

(51) Int. Cl.
*F21V 11/00* (2006.01)

(52) U.S. Cl.
USPC ..... 362/546; 362/548; 362/549; 362/543; 362/544; 362/545

(58) Field of Classification Search
USPC ..... 362/459–549
See application file for complete search history.

(56) References Cited

U.S. PATENT DOCUMENTS

| | | | | |
|---|---|---|---|---|
| 2009/0147528 | A1* | 6/2009 | Wang | 362/501 |
| 2009/0154166 | A1* | 6/2009 | Zhang et al. | 362/294 |
| 2010/0176608 | A1* | 7/2010 | Schelberg et al. | 293/117 |

* cited by examiner

*Primary Examiner* — William Carter
(74) *Attorney, Agent, or Firm* — Husch Blackwell LLP; Robert C. Haldiman; H. Frederick Rusche

(57) ABSTRACT

The present invention relates to a lighting unit for vehicles, comprising a light source arranged on a circuit board and further comprising an optical attachment mounted in the direction of light emission in front of the light source, said optical attachment comprising at least one holding turret on one of the sides facing the circuit board such that, at its mounting position, the holding turret slots into a hole drilled into the circuit board, wherein the optical attachment is positive-locking to a holding body arranged on one of the sides facing away from the light source, wherein the holding body is molded to a carrier frame, and wherein the holding body or the carrier frame snaps on to the optical attachment.

9 Claims, 4 Drawing Sheets

LIGHTING UNIT FOR VEHICLES AND MOUNTING METHOD

CROSS-REFERENCE TO RELATED APPLICATIONS

The present application claims priority to and incorporates herein by reference European Patent Application Serial No. 09 177 001.6 filed on Nov. 25, 2009.

BACKGROUND

The present invention relates to a lighting unit for vehicles, comprising a light source mounted on a circuit board and further comprising an optical attachment mounted in the direction of light emission in front of the light source, said optical attachment comprising at least one holding turret on one of the sides facing the circuit board such that, at its mounting position, the holding turret slots into a hole drilled into the circuit board, wherein the optical attachment is positive-locking to a holding body arranged on one of the sides facing away from the light source.

The present invention further relates to a method of mounting a lighting unit such that an optical attachment is joined to a circuit board populated with multiple light sources and also joined to a holding body.

Publication DE 10 2007 034 123 A1 discloses a lighting unit for vehicles comprising a circuit board populated with a light source and further comprising an optical attachment mounted in the direction of light emission in front of the light source. Said optical attachment comprises two holding turrets, each slotting into a recess in a holding body located on the back of the circuit board such that, at a mounting position, the optical attachment can be riveted to the holding body in a positive locking manner. This arrangement ensures an accurate alignment of the joined components such as the optical attachment, light source and circuit board. A disadvantage of the prior art lighting unit is that the unit is not mounted until an extra step of the process is taken after slotting the holding turrets into the recesses.

SUMMARY OF THE INVENTION

The present invention presents a lighting unit for vehicle and a method of installing said lighting unit such that the components can accurately positioned and mounted in a simple and cost-efficient manner.

In order to accomplish this task, the invention according to the characterizing clause of patent claim 1 is characterized in that the holding body is molded to a carrier frame and in that the holding body or the carrier frame snaps to the optical attachment.

According to the invention, a holding body is molded to a carrier frame intended to hold the light sources, the optical attachments and, preferably, the front lens. Furthermore, the optical attachment snaps to the carrier frame and/or the holding body such that the ensuing subassembly can be uninstalled in a non-destructive way, the advantage being that repairs can be made to remedy a defect.

According to one embodiment of the invention, the carrier frame may comprise a plurality of spring elements pointing in the direction of light emission, said spring elements latching to matching hooks of the optical attachment installed. An advantage is that the optical attachment need not be attached to the holding body beforehand. It is enough to preliminarily place the optical attachment on the circuit board or the holding body.

According to another embodiment of the invention, cuboid heat sink may be located between the holding body and the circuit board such that said heat sink snaps to the holding body. The heat sink and the holding body make up an assembly unit that a catch mechanism attaches to the further assembly unit made up of the optical attachment and the circuit board. This essentially reduces the number of steps required to assemble the lighting unit.

According to an embodiment of the invention, the heat sink may mount to and dismount from the holding body by a recess-to-catch connection, wherein a spring clip of the holding body presses against the bottom plate inside the heat sink. Said bottom plate is located on the side of the heat sink facing the circuit board. This may provide a floating joint between the heat sink and the holding body. The spring clip is designed such that it is able to compensate for geometric, thermal and mechanical tolerances of the subassembly and to provide a long-term and reliable thermal transition from the circuit board to the light source and the heat sink.

According to another embodiment of the invention, the holding turrets of the optical attachment in conjunction with the matching may recess in the circuit board just preliminarily position and attach the elements such that all subsequent snapping processes required to assemble the lighting unit are prevented from putting any mechanical stress on the circuit board. The advantage is that the circuit board need not be separately tested following assembly.

According to another embodiment of the invention, the circuit board may have a flexible covering layer which, at its mounting position, reaches into a gap between an edge of the hole and the holding turret in order to preliminarily clamp the optical attachment to the circuit board. This would preliminarily attach the circuit board without putting any mechanical stress on said circuit board.

The method according to the invention may comprise the following steps: Putting the optical attachment in place on the circuit board such that a first subassembly is made up by a holding turret of the optical attachment slotting into a hole drilled into said circuit board; providing a form-fit link of a heat sink to the holding body molded to a carrier frame such that a second subassembly is created; and providing a form-fit link of the first and second subassemblies.

A particular advantage of the method according to the invention is that it provides quick assembly while treating the components with care. Making two subassemblies and afterwards linking them up preferably by snap-fitting them such that they can be disassembled again reduces the number of steps of the assembly process. Moreover, a test of the circuit board is not required because it is not put under any mechanical stress during assembly.

Further features and advantages of the present invention, as well as the structure and operation of various embodiments of the present invention, are described in detail below with reference to the accompanying drawings.

BRIEF DESCRIPTION OF THE DRAWINGS

The text below explains an embodiment of the invention with reference to the drawings.

The following is shown:

FIG. 2 is an exploded view of the lighting unit comprising a carrier frame that a plurality of holding bodies is snapped on to, further comprising a circuit board populated with light sources, and further comprising a lens that a plurality of optical attachments is assigned to;

DETAILED DESCRIPTION

A lighting unit 1 for vehicles may, for example, generate a low beam, daytime running light, indicator light, position light function and/or a combination of these lighting functions and is installed at the front of a motor vehicle. The lighting unit 1 can be elongated and integrated in a headlamp of the vehicle.

Figure 1:
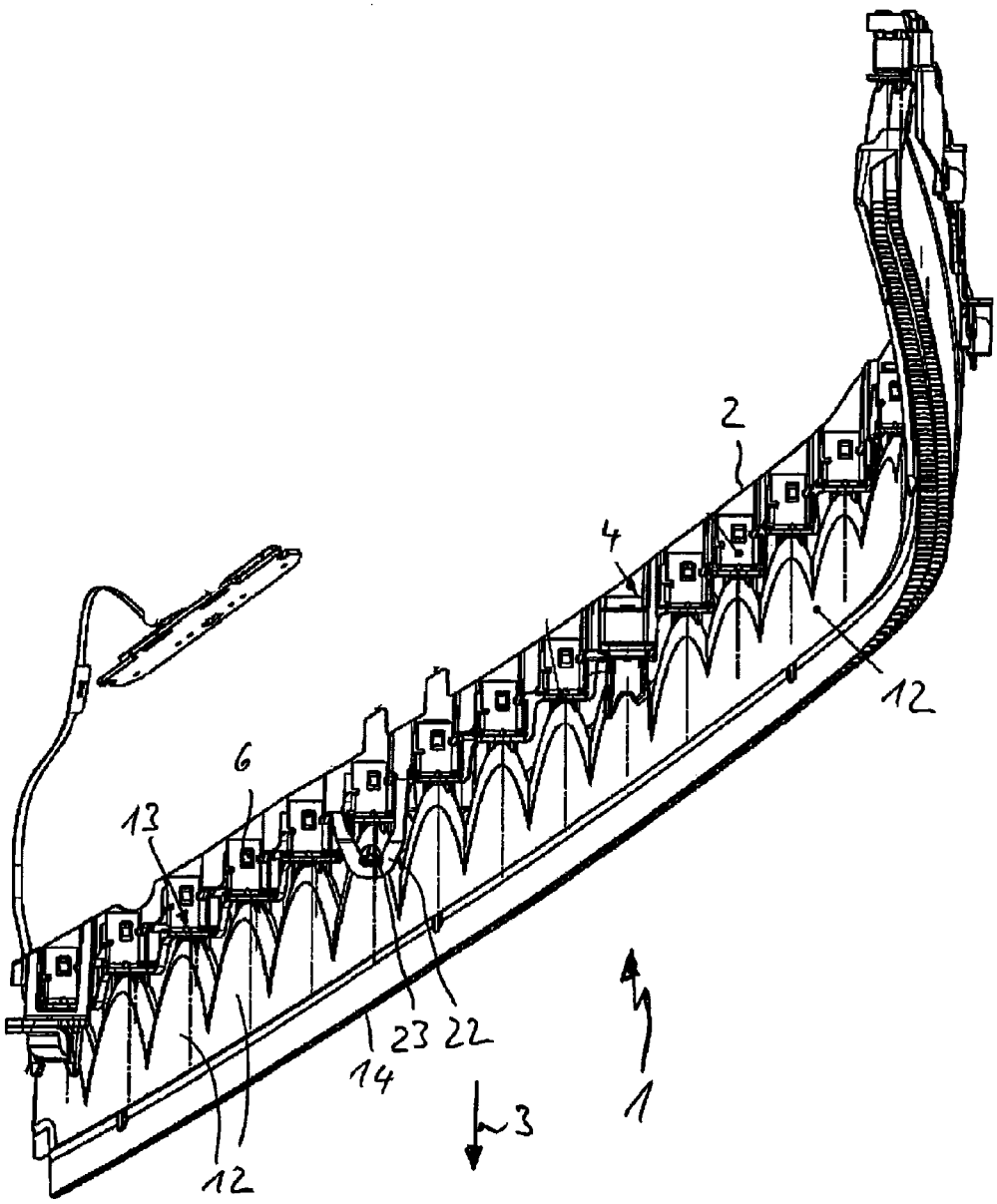
FIG. 1 is a top view of a fully assembled lighting unit.
Figure 2:
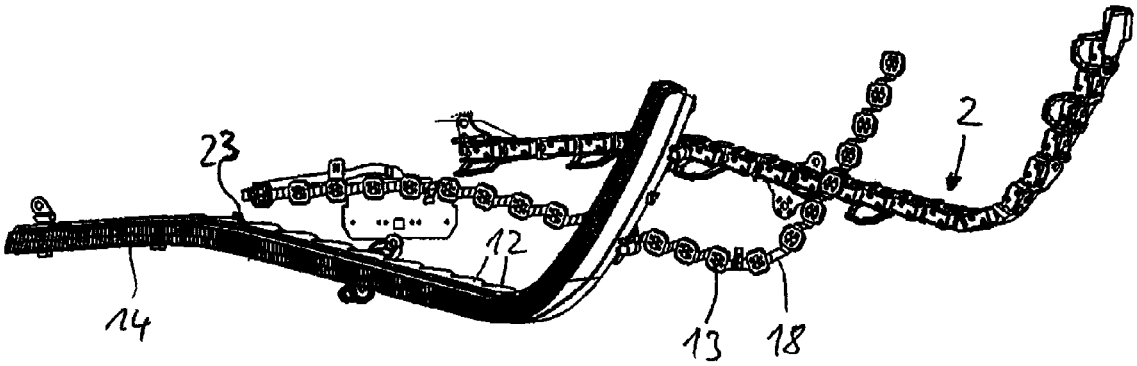
Figure 3:
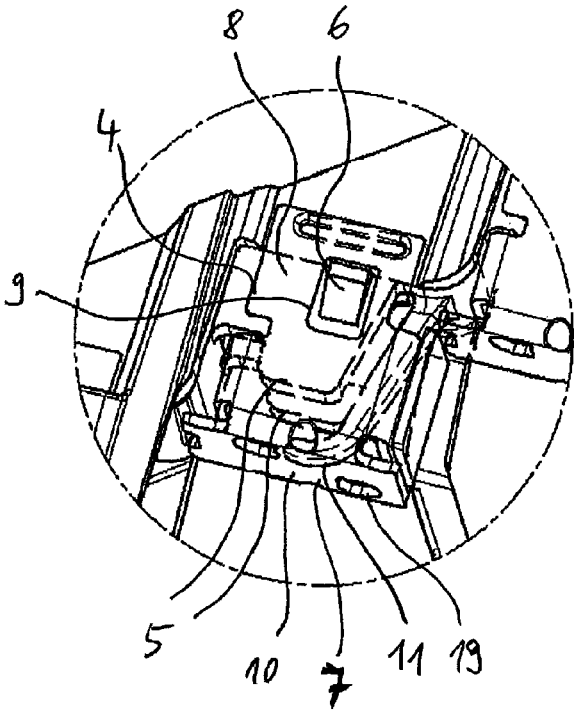
FIG. 3 is a perspective top view of a heat sink mounted on the holding body.
Figure 4:
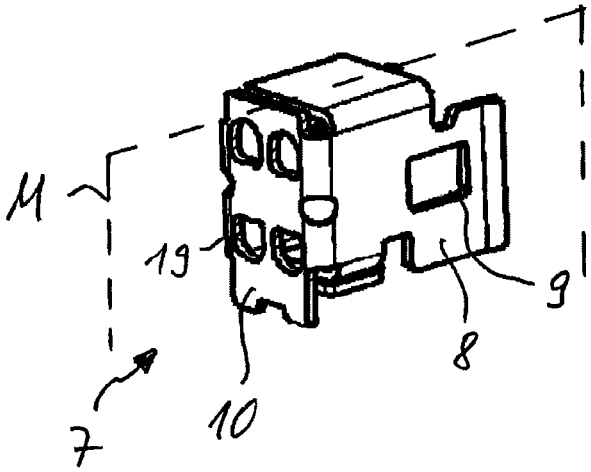
FIG. 4 is a perspective front view of the heat sink.
Figure 5:
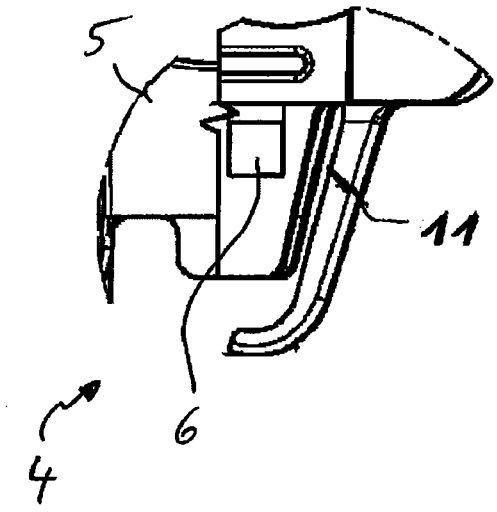
FIG. 5 is a top view of the holding body molded to the carrier frame.
Figure 6:
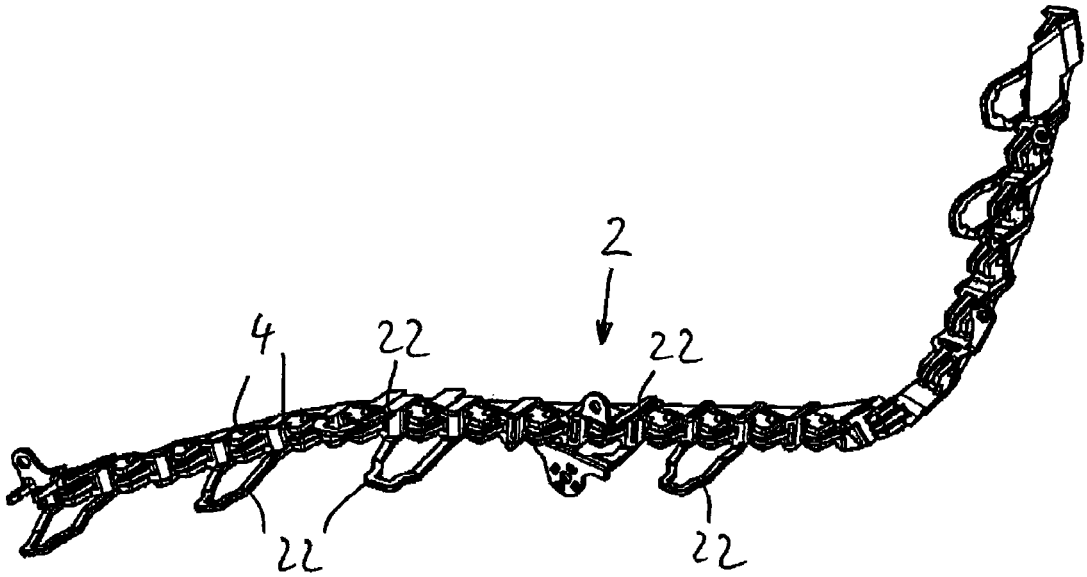
FIG. 6 is a perspective front view of the carrier frame and the holding bodies in a serial arrangement.
Figure 7:
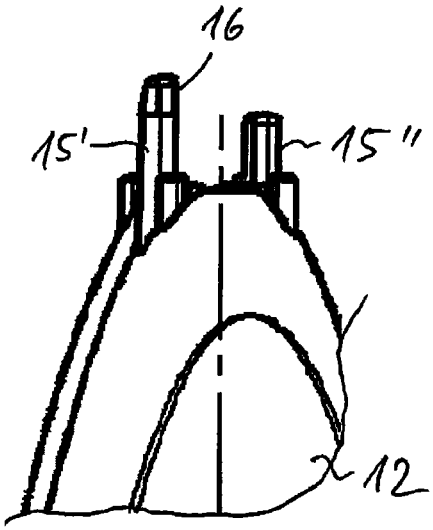
FIG. 7 is a top view on some of an optical attachment with holding turrets facing away from the direction of light emission.
Figure 8:
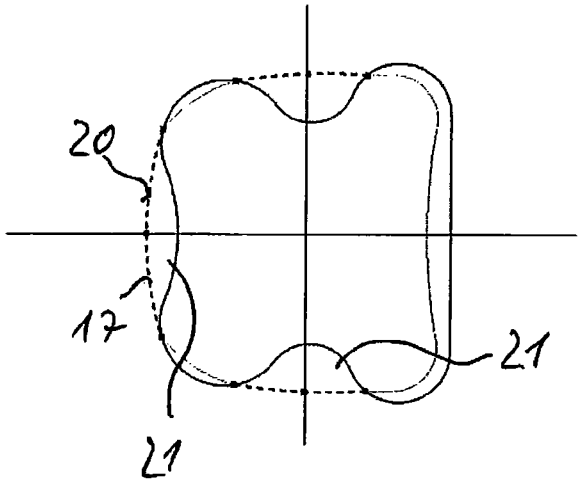
FIG. 8 is a sketch of a circuit board area around a drill hole, wherein a flexible covering layer partly overlaps the drill hole in its initial state.

In the depicted embodiment, the lighting unit 1 comprises an elongated carrier frame 2 with a U-shaped cross-section such that said carrier frame 2 is mounted on a housing (not shown) of the headlamp. A plurality of rows of holding bodies 4 in a two-dimensional and three-dimensional arrangement are molded to a front side of the carrier frame 2 such that said front side is facing in the direction of light emission. Each holding body 4 is pot-shaped and comprises wall 5 protruding in the direction of light emission, wherein a top and/or a bottom wall 5 has a slanting face 6 narrowing in the direction of light emission 3 and serving as a locating element. The purpose of this slanting face 6 is to provide a detachable locking connection between the holding body 4 and a cuboid heat sink 7, wherein the heat sink 7 comprises opposing side walls 8 each of which has a recess 9 that the slanting face 6 slots into in its assembled position. FIG. 4 illustrates that a recess 9 is in the side wall 8 on either side of a mid plane M of the heat sink 7. The side walls 8 are slightly resilient and connect to a bottom plate 10 that is at the front if looking in the direction of light emission 3. The side walls 8 of the heat sink 7 are slightly resilient in relation to the mid plane M such that the heat sinks 7 easily snap on to and come off of the appropriate holding bodies 4.

The holding body 4 further comprises a spring clip 11 that protrudes in the direction of light emission 3 and, when the heat sink 7 is mounted on the holding body 4, presses against an inside face of the bottom plate 10, thus mounting the heat sink 7 on the holding body 4 and securing it at its position.

The lighting unit 1 further comprises a plurality of optical attachments 12 which are preferably tulip-shaped and intended to reflect the light emitted by the LED light sources 13. The optical attachments 12 interconnect in a row and follow the outline of the carrier frame 2. They may form an integral whole with a lens 14 at the front end of the lighting unit 1. Alternatively, the strip of optical attachments 12 can be simply placed in a recess of the lens 14.

Each of the optical attachments 12 comprises holding turrets 15', 15" at an end facing towards the carrier frame 2. A first holding turret 15' is longer than a second holding turret 15". The long holding turret 15' has a chamfered insertion end 16 to facilitate inserting said holding turret 15' in a hole 17 in a circuit board 18 or a hole 19 in the heat sink 7. The cross-section of both the first holding turret 15' and the second holding turret 15" is shaped like a horseshoe such that it is easier to insert the holding turrets 15', 15" in the holes 17, 19. Particularly, the shorter holding turret 15" can slot into the current hole 17, 19 on its own.

The circuit board 18 is designed as a flexible circuit board whose outline matches the outline of the carrier frame 2 and the strip of optical attachments 12 and the lens 14. The circuit board 18 is populated with a plurality of the LED light sources 13 arranged in rows. The LED light sources 13 are mounted on side of the circuit board 18 facing the lens 14.

In order to obtain a first subassembly made up of the optical attachment 12 and the circuit board 18, the optical attachments 12 are preliminarily positioned and attached by the holding turrets 15', 15" slotting into the holes 17 of the circuit board 18. At this preliminary position, the optical attachments 12 can be loosely attached to the circuit board 18. Under preliminary attachment, the optical attachments 12 are clamped to the circuit board 18 such that lugs 21 of a flexible covering layer on the circuit board 18 protruding from the edge 20 of hole 17 in said circuit board 18 are bent in said hole 17 by the holding turrets 15', 15" to fill a gap between said edge R and 20 of said hole 17 and said holding turrets 15' and 15". This preliminarily clamps the optical attachments 12 to the circuit board 18.

A second subassembly is obtained by linking the carrier frame 2 to the heat sinks 7 separately allocated to the holding bodies 4. As described earlier, each heat sink 7 is locked or clamped to the matching holding body 4.

The last step after making the first subassembly and the second subassembly is to provide a form-fit link between the first subassembly and the second subassembly. The first subassembly preferably snaps on to the second subassembly such that the holding turrets 15', 15" slot into the holes 19 of the heat sink 7. In order to link up the two subassemblies, the carrier frame 2 comprises U-shaped spring elements 22 on one top and underside that protrude in the direction of light emission 3. These spring elements 22 interact with the latching hooks 23 molded to the corresponding top and undersides of the optical attachments 12. When the lighting unit 1 is fully assembled, the spring elements 22 interlock with the latching hooks 23. The ensuing clip joint can be opened manually should disassembly be required. The number of spring elements 22 and latching hooks 23 and the distance between the two types of elements is chosen to ensure that the first subassembly reliably links to the second subassembly.

The carrier frame may be made of a POM plastic material.

In view of the foregoing, it will be seen that several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

REFERENCE ITEMS

1 lighting unit
2 carrier frame
3 direction of light emission

4 holding body
5 walls
6 slanting face of locating element
7 heat sink
8 side wall
9 recess
10 bottom plate
11 spring clip
12 optical attachment
13 LED light source
14 lens
15', 15" holding turrets
16 slot-in slant
17 hole
18 circuit board
19 hole
20 edge
21 lug
22 spring element
23 latching hook
M mid plane

The invention claimed is:

1. A lighting unit for vehicles, comprising:

a light source arranged on a circuit board;

an optical attachment mounted in a direction of light emission in front of the light source, said optical attachment comprising at least one holding turret on a first side facing the circuit board such that, at its mounting position, the holding turret slots into a hole drilled into the circuit board;

wherein the optical attachment is positive-locking to a holding body arranged on a second side facing away from the light source; the holding body is molded to a carrier frame; at least one of the holding body or the carrier frame being configured to snap on to the optical attachment; and multiple spring elements, on at least one of a top side or an underside of the carrier frame, extending in the direction of light emission such that every spring element rests behind a latching hook molded to the optical attachment.

2. The lighting unit of claim 1, further comprising a cuboid heat sink located between the holding body and the circuit board, the cuboid heat sink being snapped on to the holding body.

3. The lighting unit of claim 1, further comprising a heat sink having a recess in a side wall and a locating element configured such that at a mounting position, the locating element of the holding body snaps into an inside of said holding body.

4. The lighting unit of claim 1, further comprising the holding body having a spring clip, said spring clip, at a mounting position, pushing against a bottom wall perpendicular to a side wall of a heat sink.

5. The lighting unit of claim 1, further comprising a locating element of the holding body and a recess in a side wall of a heat sink are each arranged on sides opposite to a mid plane of one of the holding body or the heat sink.

6. The lighting unit of claim 1, further comprising the optical attachment comprises at least two holding turrets of different lengths; the longer one of the holding turrets has a chamfered insertion end.

7. The lighting unit of claim 6, further comprising the holding turrets being geometrically shaped such that the shorter of the two holding turrets automatically slots into a hole drilled into the circuit board as the optical attachment moves towards the circuit board in the mounting process.

8. The lighting unit of claim 1, further comprising the circuit board being a flexible circuit board whose flexible covering layer has a tang protruding from an edge of the drill hole such that said tang, when a holding turret slots into the drill hole, engages a gap between the edge of the drill hole and the holding turret in order to preliminarily clamp the optical attachment to the circuit board.

9. A method of mounting a lighting unit such that an optical attachment is joined to a circuit board populated with multiple light sources and also joined to a holding body, said method comprising:

putting the optical attachment in place on the circuit board such that a first assembly unit is made by a holding turret of the optical attachment slotting into a hole drilled into the circuit board, making a second assembly unit by locking a heat sink with the holding body molded to a carrier frame, locking the first assembly unit and the second assembly unit together, and extending multiple spring elements on at least one of a top side or an under of the carrier frame in the direction of light emission such that every spring element rests behind a latching hook molded to the optical attachment.

* * * * *